US006205595B1

(12) United States Patent
Ecker

(10) Patent No.: US 6,205,595 B1
(45) Date of Patent: Mar. 27, 2001

(54) SUPPLEMENTAL TANK FOR USE WITH LOW FLOW VOLUME TOILET

(76) Inventor: Frederick K. Ecker, 1202 Challenger Ave., Davenport, FL (US) 33837-6446

( * ) Notice: Subject to any disclaimer, the term of this patent is extended or adjusted under 35 U.S.C. 154(b) by 0 days.

(21) Appl. No.: 09/511,284

(22) Filed: Feb. 23, 2000

(51) Int. Cl.[7] ..... E03D 1/22

(52) U.S. Cl. ..... 4/363; 4/353

(58) Field of Search ..... 4/363, 353, 354, 4/378, 364, 325, 324, 340, 346, 345, 665, 415

(56) References Cited

U.S. PATENT DOCUMENTS

| | | | | |
|---|---|---|---|---|
| 665,887 | | 1/1901 | Emery . | |
| 2,190,773 | | 2/1940 | Dunn . | |
| 3,995,327 | | 12/1976 | Hendrick . | |
| 4,183,108 | * | 1/1980 | Hamilton | 4/354 |
| 4,371,992 | * | 2/1983 | Rivera | 4/353 |
| 5,495,624 | | 3/1996 | Lisook et al. . | |
| 5,754,987 | | 5/1998 | Johansson et al. . | |

* cited by examiner

*Primary Examiner*—Gregory L. Huson
*Assistant Examiner*—Huyen Le
(74) *Attorney, Agent, or Firm*—Julian C. Renfro, Esq

(57) ABSTRACT

A supplemental tank for use with a low flow volume toilet, with this supplemental tank being configured to rest atop the integral tank of the toilet and to provide additional water for the flushing of the toilet. Communication is provided between the supplemental tank and the tank integral with the toilet, with this including at least one elongate tube mounted in the bottom member of the supplemental tank, with a lower portion of the tube extending below the bottom member. When the supplemental tank has been placed atop the integral toilet tank, the tube extends down into the water normally contained in the integral tank. A vacuum pump is connected to an upper portion of the supplemental tank so that a reduced pressure can be created, on occasion, in the upper interior portion of the tank. When the toilet is flushed, water flows out of the integral tank and as a result of the provision of the elongate tube, water contained in the supplemental tank flows into the integral tank, to aid in the flushing of the toilet. Operation of the vacuum pump is brought about subsequent to the flushing of the toilet, to cause a reduction of the pressure in the supplemental tank, with this causing water to be drawn from the integral tank during its refilling, upwardly through the elongate tube to bring about the refilling of the supplemental tank. The vacuum pump is shut off when the water in the supplemental tank reaches a certain level.

19 Claims, 4 Drawing Sheets

FIG 2
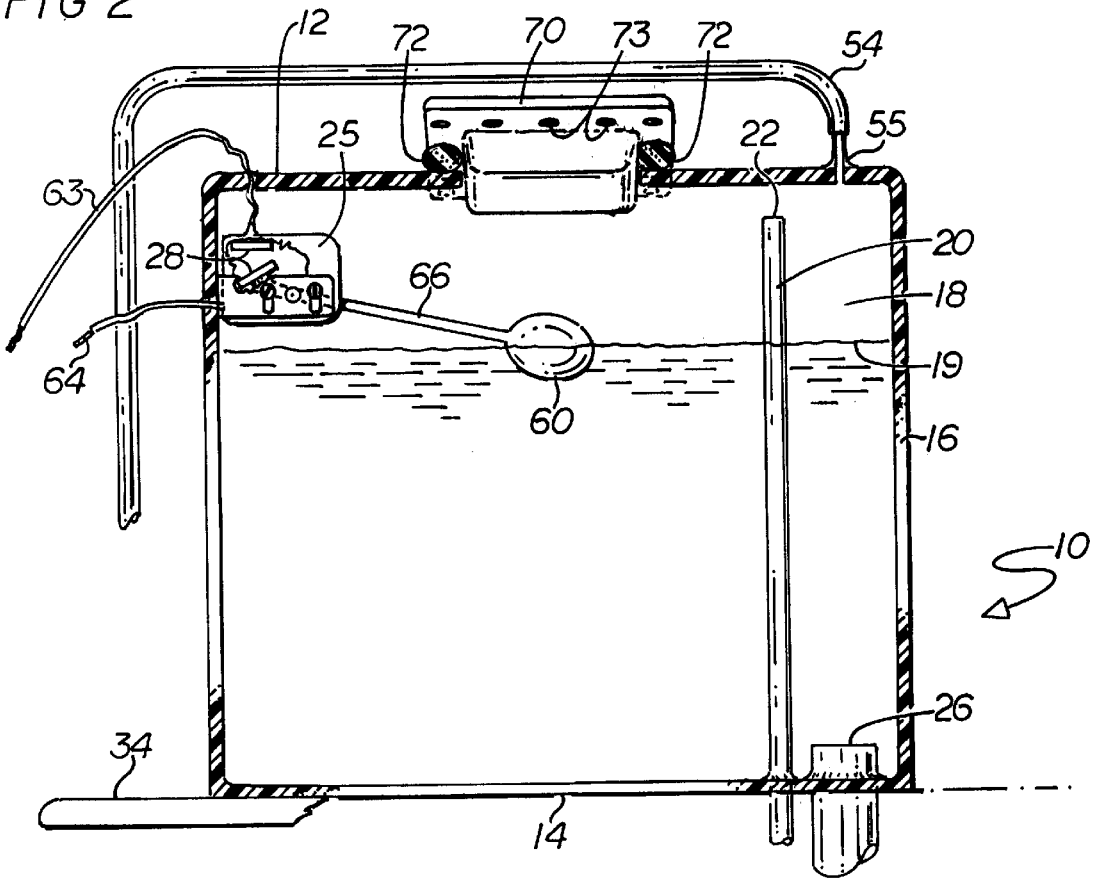
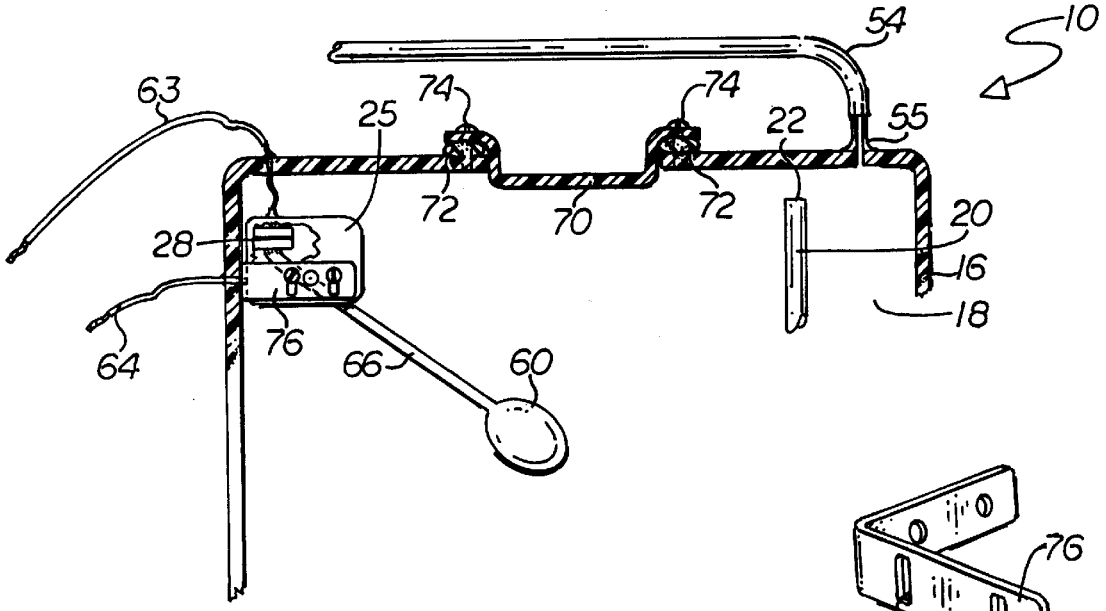
FIG 3
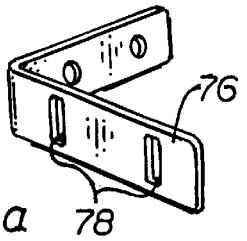
FIG 2a

FIG 4
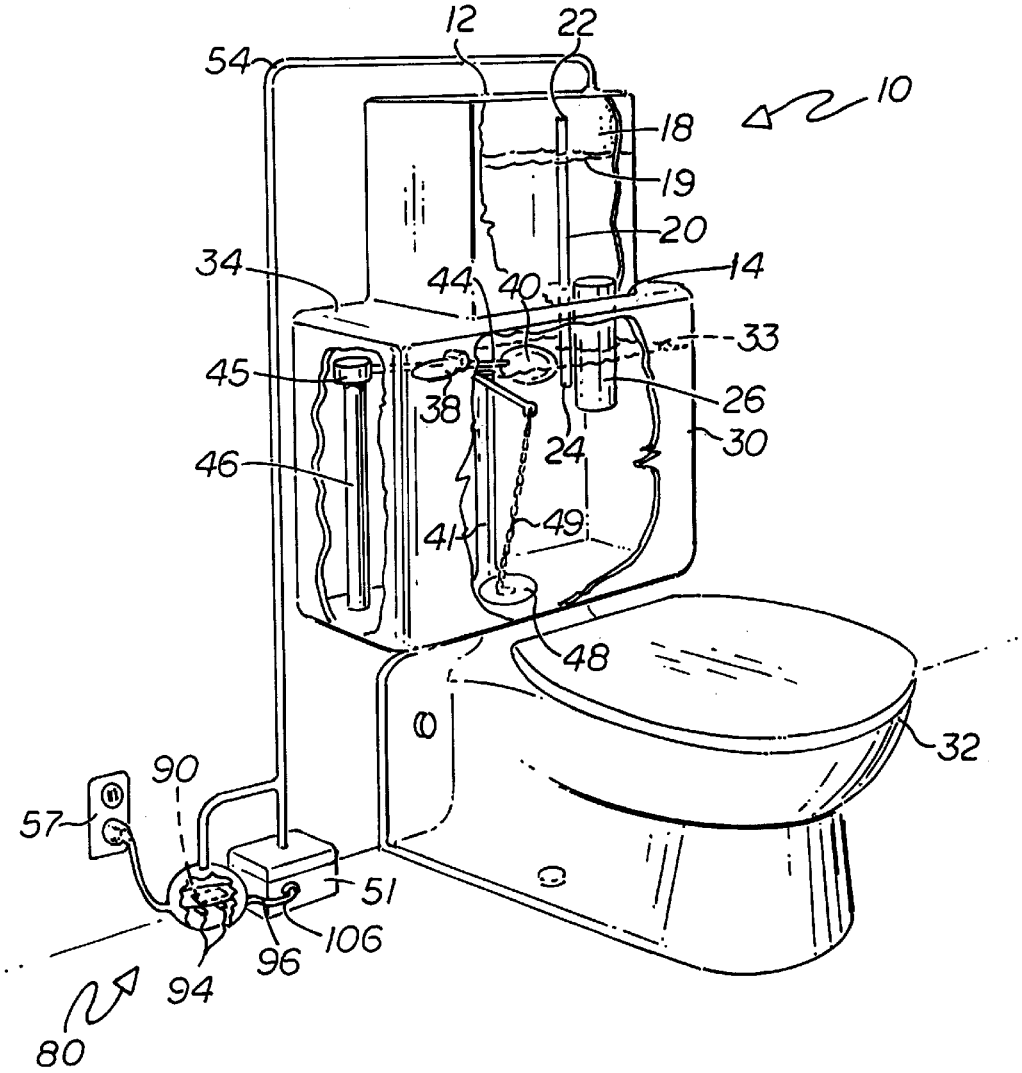
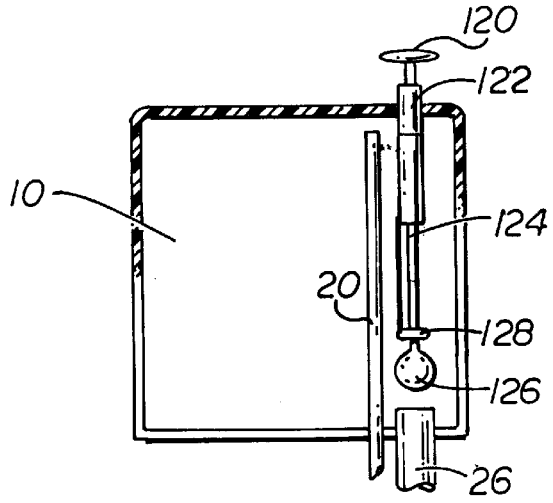
FIG 7

SUPPLEMENTAL TANK FOR USE WITH LOW FLOW VOLUME TOILET

BACKGROUND OF THE INVENTION

In recent years toilets manufactured primarily for home use have been of the "low flow volume" type, with the water tank of such toilets being designed to contain only a limited amount of water, such as 1.6 gallons. It is the intent of such a design to effect a saving of water.

However, it is often the case, particularly when dealing with solid waste, that the user will need to flush the toilet a second time, or even a third time, with the net result that more water has been expended than would have been the case had the integral toilet tank been designed to hold a greater quantity of water.

In addition to often requiring multiple flushing of the toilet, the low flow volume toilet design often brings about a clogged condition, needing at a minimum for the user to utilize from time to time, a plunger type device known as a plumber's friend in an effort to unclog the sewer line leading away from the toilet as well as between the house and the main sewer line.

It is the purpose of the present design to overcome these disadvantages accompanying the use of low flow volume toilets.

SUMMARY OF THE INVENTION

I have provided in accordance with this invention a supplemental tank configured to rest atop the upper edge of the integral tank of a conventional toilet, typically a low flow volume toilet, with the supplemental tank serving to supply an additional quantity of water to the integral tank of the toilet at the time of a flush. The supplemental tank is provided with top and bottom members as well as sidewalls extending in a vacuum-tight manner between the top and bottom members.

Of particular consequence to this invention is the provision of suitable interconnection means between the two tanks, with this preferably taking the form of a pair of elongate tubes mounted in a sealed manner in the bottom member of the supplemental tank, with a first of the tubes being of a greater length than that of the second tube. Both of these tubes are of a length to extend down into the water contained in the integral tank of the toilet when the supplemental tank has been placed atop the integral tank.

This novel supplemental tank is utilized in combination with a vacuum pump connected to an upper interior portion of the supplemental tank, with it being the purpose of the vacuum pump to selectively bring about a low pressure in such upper interior portion of the supplemental tank. Upon the toilet being flushed, this causes the flow of water out of the integral tank, and as a result of the provision of the pair of elongate tubes, water contained in the supplemental tank is caused to flow into the integral tank, to aid in the flushing of the low flow toilet.

It is obvious that means must be provided for activating the vacuum pump on proper occasions, to cause a reduction of the pressure in the upper interior portion of the supplemental tank, with the vacuum pump in such instance serving the necessary function of causing water to be drawn upwardly through the elongate tubes from the integral tank, thus bringing about the refilling of the supplemental tank. Then, when the proper water level has been restored in the supplemental tank, the cessation of the operation of the vacuum pump is reliably brought about.

In accordance with a first embodiment of my invention, I may utilize a float switch involving a positionally sensitive component, with such switch being mounted in either an interior or an exterior portion of the supplemental tank. The float portion of the float switch is positioned so as to be able to float on the surface of the water in the supplemental tank, and to move downwardly at such time as the toilet has been flushed. Such downward movement of the float causes the closing of electrical contacts so as to bring about operation of the vacuum pump. It is to be understood that after the refilling of the integral tank has begun, and after the vacuum pump has brought a sufficient amount of water upwardly into the supplemental tank through the vertically disposed tubes, a desired water level will be reached such that the float will move upwardly in the supplemental tank to a location such that the circuit to the vacuum pump will be broken.

In accordance with another embodiment of my invention, I may dispense with the use of a float arrangement disposed in the supplemental tank and instead utilize a vacuum switch placed so as to be sensitive to the amount of negative pressure extant at any moment in the upper interior portion of the supplemental tank.

Although the vacuum pump will not be operating after a sufficiently low pressure has been caused to exist in the upper interior portion of the supplemental tank, when the water level in the supplemental tank drops as a result of the flushing of the toilet and the outward flowing of water through the tubes, a lesser condition of negative pressure will be caused to exist in the upper interior portion of the supplemental tank. This lesser amount of negative pressure in the supplemental tank causes a diaphragm used in the vacuum switch to move and bring about the circuit to the vacuum pump being completed, thus to cause the vacuum pump to operate to accomplish the refilling of the supplemental tank.

It is thus to be seen that in accordance with this invention I have provided an easily affordable arrangement for enhancing the functioning of a low flow volume toilet.

A primary object of this invention is to provide an easily affordable, sealed supplemental tank of a size to be readily accommodated on top of the integral tank of a toilet, with water contained in the supplemental tank being automatically dispensed under certain conditions, to aid in the flushing of a low flow volume toilet.

It is another object of this invention to provide a sealed supplemental tank intended to be placed atop the tank of a conventional low flow volume toilet, with the supplemental tank providing extra water needed for the proper flushing of the toilet, and with either of two different switching arrangements being utilized to automatically bring about a refilling of the supplemental tank after each flush.

It is yet another object of this invention to provide a sealed supplemental tank for use with a toilet, with the supplemental tank utilized in conjunction with an automatically functioning vacuum pump, with one embodiment of my invention involving the water level normally maintained in the supplemental tank being established by the positioning of a float switch placed inside the supplemental tank.

It is yet still another object of this invention to provide a sealed supplemental tank for use with a low flow volume toilet utilized in conjunction with an automatically functioning vacuum pump, with a second embodiment of my invention involving an arrangement in which a vacuum switch is utilized to sense a certain vacuum condition existing in the upper interior portion of the supplemental tank, with this switch causing the refilling of the supplemental tank after each flush, and then causing the vacuum pump to be shut off when the supplemental tank has been refilled and a certain vacuum condition returns to the upper interior portion of the supplemental tank.

These and other objects, features and advantages will be made more apparent from a study of the appended drawings.

BRIEF DESCRIPTION OF DRAWINGS

FIG. 2 is a somewhat idealized view of my novel supplemental tank, with this view schematically illustrating to a relatively larger scale, the embodiment of my invention in which a float operated switch is utilized for bringing about operation of the vacuum pump such that a desired level of water will be maintained in the supplemental tank;

FIG. 2*a* is a fragmentary view of one type of mounting arrangement for the switch associated with the float of FIG. 2;

FIG. 3 is a view generally along the lines of FIG. 2, but here showing how as the result of the downward flow of water into the integral tank from the supplemental tank, the float has moved downwardly, with this resulting in the closing of electrical switch contacts and the bringing about of operation of the associated vacuum pump, such that it will cause the supplemental tank to be refilled with water, in preparation for the next flush;

FIG. 4 is a perspective view of a second principal embodiment of my invention, involving the use of a vacuum switch functioning to activate the vacuum pump at such time as the supplemental tank is to be refilled;

FIG. 7 is a fragmentary view of an optional arrangement, provided so as to enable a user to prevent water being delivered from the supplemental tank in certain instances, such as when only liquid waste is to be flushed.

DETAILED DESCRIPTION

Figure 1:
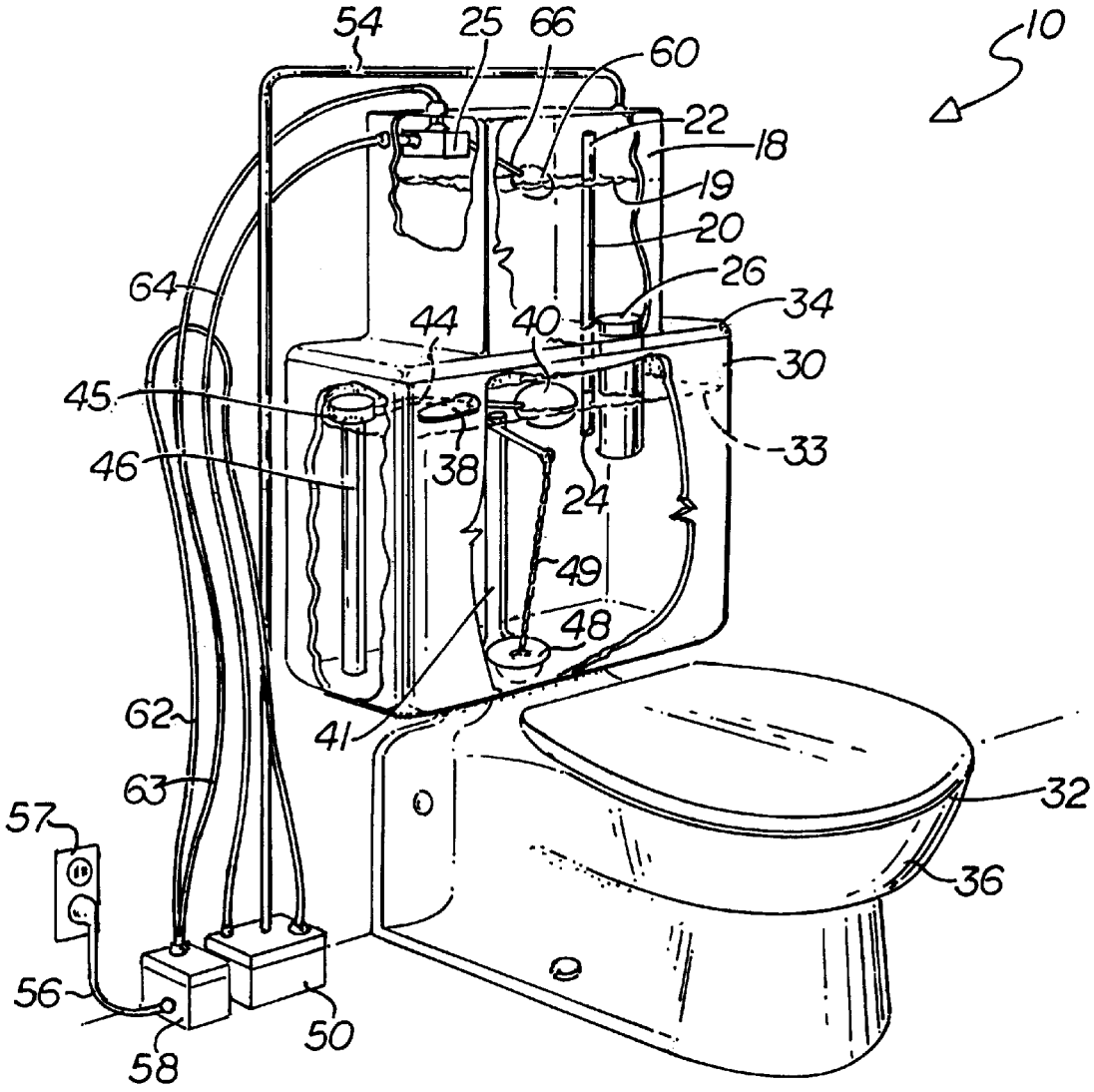
FIG. 1 is a perspective view of a typical toilet upon the integral tank of which rests a novel supplemental tank, with this figure depicting a first embodiment of my invention in which a float operated switch is utilized in the supplemental tank, with a pair of tubes passing in a sealed relationship down through the bottom of the supplemental tank, with one of these tubes responsible for carrying water downwardly into the integral tank of the toilet at the time of a flush, as well as being responsible for carrying water upwardly for the refilling of the supplemental tank in response to the efforts of a vacuum pump activated by the float switch.

With initial reference to FIG. 1, it will be seen that I have shown a supplemental tank 10 adapted to contain water, and intended to be placed atop a tank 30 integral with a toilet 32. It is the purpose of the supplemental tank 10 to supplement the water contained in the tank 30 at the time of a flush, so as to aid the removal of solid waste from the bowl 36 of the toilet 32.

Although not limited to use with a so-called low flow volume toilet, it is nevertheless typical for my novel supplemental tank to be used with a toilet of such type. As will be explained at length hereinafter, my novel supplemental tank 10 functions to supply an additional, pre-established amount of water at the time of flush, to supplement the relatively small quantity of water contained in the integral tank 30 of a low flow volume toilet. Quite advantageously, the amount of water to be delivered from the supplemental tank 10 into the integral tank at the time of a flush can be adjusted by the user.

As will be noted from FIG. 1, the supplemental tank 10 can be somewhat smaller than the integral tank 30, and if the supplemental tank has a smaller base or "footprint" area than the top of the tank 30, an adapter 34 can be utilized to rest on the upper edge of the tank 30, to properly support the supplemental tank 10.

Certain details of the supplemental tank are more clearly revealed in FIG. 2, and from this figure it will be seen that the supplemental tank is provided with a top member 12 and a bottom member 14. It is to be further understood that sidewalls 16 extend in a vacuum-tight manner between the top and bottom members 12 and 14. The supplemental tank 10 can be in the configuration of a rectangular solid, but obviously I am not to be limited to this.

Returning to a consideration of FIG. 1, it is important to observe that in accordance with this invention, I utilize means for providing communication between the supplemental tank 10 and the integral tank 30. This means involves at least one elongate tube, but preferably a pair of elongate tubes 20 and 26 that are mounted in a sealed manner in the bottom member 14 of the supplemental tank 10; note FIG. 2. From FIG. 1 it will be seen that a first of the tubes, tube 20, is of a substantially greater length than that of the second tube, tube 26. It is to be observed that both of these tubes are mounted in an essentially perpendicular relationship with the bottom member 14, and of a length to extend down somewhat below the level 33 of the water in a full integral tank 30 at such time as the supplemental tank 10 has been placed atop the integral tank of the toilet 32.

As is obvious, the tubes 20 and 26 are to be positioned so as not to interfere with the functioning of the components contained in the integral tank 30 of a conventional toilet.

Most advantageously, as a result of the provision in accordance with this invention of the pair of elongate tubes 20 and 26, water contained in the vacuum-tight supplemental tank 10 is caused to flow under the influence of gravity into the integral tank 30 when the water is flowing out of latter tank at the time of a flush, thus to contribute in a very consequential manner to the flushing procedure.

It is to be understood that supplemental tank 10 is employed with a source of vacuum needed to bring about the replenishment of the water expended from the supplemental tank at the time of a flush. This source of vacuum may be a vacuum pump resting on the floor adjacent the toilet 32. Alternatively, the vacuum pump could be placed in a remote, out-of-sight location. In FIG. 1 it will be noted that the vacuum pump 50 is connected by a relatively heavy walled tube 54 to a hollow fitting 55 extending in a vacuum tight manner through the top member 12; note FIGS. 2 and 3. It is thus to be understood that I have provided an effective, no-leak communication between the vacuum pump and the upper interior portion 18 of the supplemental tank 10. As will be described hereinafter, the pump 50 functions, on occasion, to bring about a desirably low pressure in the upper interior portion 18 of the supplemental tank.

Although I am not to be limited to any particular vacuum pump, in accordance with the embodiment of my invention depicted in FIG. 1, I preferably utilize a 12 volt vacuum pump supplied with power from a 12 volt transformer 58. One source of such vacuum pump is the McMaster-Carr Supply Company, 600 County Line Road, Elmhurst, Ill. 60126.

Obviously I am not to be limited to the use of a 12 volt A.C. power source, for I may for example use a direct current source of any safe voltage.

In the preferred instance depicted in FIG. 1, I provide for the powering of the transformer 58, an electric cord 56, which may plug into a receptacle 57 supplying 110 volts. Electric leads or wires 62 and 63 extending upwardly from the transformer 58 serve to carry electric current to a switch 25 located in the upper interior portion 18 of the supplemental tank 10; note FIGS. 1, 2 and 3. The switch 25 has normally closed contacts 28 and is operatively associated with a float 60 mounted on an arm 66. These components will be described hereinafter in greater detail. It is to be understood that electric lead 63 connects to a first terminal of the switch 25, whereas electric lead 62 continues all the way to a first terminal of the vacuum pump 50. In addition, electric lead 64 attaches to a second terminal of the switch 25 and connects to a second terminal of the vacuum pump. It is obvious that by this arrangement, the switch 25 is interposed in the circuit to the vacuum pump, with it not being possible for the vacuum pump to operate except when the contacts 28 of the switch 25 are in the closed position depicted in FIG. 3.

By virtue of this arrangement, it is possible for the vacuum pump 50 to be caused to operate automatically and without human intervention subsequent to the water level in the integral tank 30 as well as the float 60 dropping as a consequence of the toilet being flushed. The dropping of the water below the level 19 in the supplemental tank 10 takes place because of the utilization of the aforementioned pair of tubes 20 and 26, with tube 26 serving to deliver water from the supplemental tank into the integral tank at the time of flush, to aid in a highly effective manner in the flushing procedure.

It is thus to be seen that the first or principal embodiment of this invention utilizes appropriate activation means including the switch 25 and its associated float 60 for automatically causing the vacuum pump 50 to operate when the water level in the supplemental tank 10 has dropped below level 19. The arrangement involving the switch 25 and the associated float 60 also functions as a shutoff means for bringing about the cessation of the operation of the vacuum pump 50 when the water level in the supplemental tank 10 has been restored to the normal or desired level 19.

With reference again to fragmentary FIG. 2 and related FIG. 3, it will be seen that in FIG. 2 I have shown a somewhat idealized view of my novel supplemental tank, with this view schematically illustrating the embodiment of my invention in which the float operated switch 25 is utilized as the activation means for bringing about operation of the vacuum pump such that a desired level of water will be maintained in the supplemental tank. It is to be understood that the normally closed contacts of switch 25 are held in the open position by the float 60 when the float is resting atop a full tank of water, as shown in FIG. 2.

As will shortly be explained in greater detail, the lowering of the float 60 from the water line 19 of the full tank 10 to the position depicted in FIG. 3 permits the electrical contacts 28 of the normally closed switch 25 to move into their normal, circuit-closing position. This serves, through electrical wires 63 and 64 to bring about operation of the vacuum pump 50 until such time as the water in the supplemental tank 10 has been caused to return to the pre-established level 19. Upon this level having been reached, the float 60 rises to the position depicted in FIGS. 1 and 2 and the contacts 28 of the switch 25 are caused to open, with this bringing about a cessation of the operation of the vacuum pump.

Obviously I am not to be limited to any particular switch or switch manufacturer, but I have found that a float control switch manufactured by Beckett Corporation of Dallas, Tex. to be quite satisfactory, this being their Model 1502UR.

As shown in FIG. 2*a*, the switch 25 can be mounted on a generally L-shaped supporting bracket 76, with suitable mounting screws securing one arm of the bracket 76 to the sidewall 16 of the tank. It is to be noted that elongate holes or slots 78 are provided in the outwardly extending arm of the bracket 76, with these slots readily permitting the effective height of the switch 25 to be adjusted with respect to the top member 12 of the tank 10.

Although it is seldom that the float switch 25 needs attention, I prefer to provide in top member 12 of the tank 30, an access panel or hatch 70, visible in FIGS. 2 and 3. This panel or hatch resides on a relatively thick gasket 72 that extends entirely around the periphery or circumference of the hatch or door 70, thus to assure that a desirable level of vacuum can be maintained in the upper interior portion 18 of the tank 10. I prefer to hold the panel or hatch in vacuum tight contact with gasket 72 and the top member 12 by utilizing in the panel a closely spaced series of holes 73. In FIG. 2 I have turned the panel or hatch 70 out of its normal position so as to reveal the close spacing of the holes 73. It is to be understood that through each of these holes, a screw 74 extends, to threadedly engage the top member 12 of the supplemental tank in a tightly fitting manner.

It should now be clear that the toilet 32, upon being flushed, directly causes the flow of water out of the integral tank 30, which water serves in an expected manner to eliminate the waste accumulated in the bowl portion 36 of the toilet 32. Because of the provision of the pair of elongate tubes 20 and 26 in accordance with this invention, water contained in the vacuum-tight supplemental tank 10 is caused to flow into the integral tank 30 at the time water is flowing out through the aperture in the bottom of the tank 30, thus to contribute in a very consequential manner to the flushing procedure. It is possible to utilize a single tube, but I find that by using the pair of elongate tubes 20 and 26 of selected lengths, a better result is obtained.

Before proceeding further with a discussion of the significant features of this invention, it should be pointed out that the integral tank 30 is provided with customarily used components, including a flush handle 38 and a float 40 serving to control the flow of water into the integral tank 30. The float 40 is mounted on a rod 44 operably attached to the conventional water inlet valve 45 mounted on water supply tube 46. A conventional overflow tube or pipe 41 is utilized in the integral tank 30.

In a well known manner, when the flush handle 38 has been manipulated, a flapper valve 48 or the like, mounted in the outlet in the bottom of the integral tank, is lifted by chain 49 and caused to unseat. The unseating of the valve 48 permits water contained in the integral tank 30 to flow into the toilet bowl 36. Upon the water level in the integral tank dropping as a result of this outflow, the float 40 moves downwardly, with the movement of the rod 44 causing the water inlet valve 45 to open. It will be readily understood that the opening of the water inlet valve 45 permits fresh water at the suitably high pressure typical for a municipality to commence the refilling of the integral tank 30.

It has previously been mentioned that as a consequence of the provision of the pair of elongate tubes 20 and 26 residing in a sealed relationship with respect to the bottom member 14 of the tank 10, effective communication between the two tanks is established, making it possible for water contained in the supplemental tank 10 to flow under the influence of gravity through the shorter tube 26 into the integral tank 30 subsequent to the unseating of the flapper valve 48.

From FIG. 1 it is to be seen that the tube 20 does not extend as deeply into the water contained in the integral tank 30 as does the tube 26, so when the water level 33 in the integral tank 30 falls (about one inch) the lower end 24 of tube 20 will be exposed, permitting air to be drawn up through tube 20 into the upper interior portion 18 of the supplemental tank 10, thus to displace the water flowing out of the supplemental tank through tube 26 into the integral tank 30.

It is to be noted that the upper portion 22 of tube 20, the longer tube, is disposed at a location relatively near the top member 12 of the supplemental tank 10, such that the upper portion 22 is disposed well above the location 19 of the water level in tank 10 when this tank is full. It is important that the lower end 24 of the tube 20 be disposed below the water line 33 of the integral tank 30 when the tank 30 has been filled.

With regard to the tube 26, the shorter tube, because the upper aperture of the tube 26 is disposed relatively near the bottom 14 of the supplemental tank 10, the tube 26 carries the water from the supplemental tank 10 into the integral tank 30. In order for the water in supplemental tank 10 to be of assistance in the flushing of the toilet, it is highly desirable for the tube 26 to be large enough to rapidly drain the supplemental tank 10, with this taking place before the integral tank has been emptied. For this reason I prefer for the tube 26 to be approximately 1½ inches in diameter, so that essentially all of the water contained in the supplemental tank will be able to flow downwardly in a rapid manner, and to be in sufficient quantity as to aid significantly in the flushing of the low flow volume toilet. The longer tube, tube 20, is typically one-half the diameter of the tube 26, but I am obviously not to be limited to these dimensions.

When the water in the integral tank 30 has reached a sufficiently low level, the conventional flapper valve 48 reseats in a well understood manner. As a consequence of fresh water flowing out of the now open water inlet valve 45 due to the lowered position of the float support rod 44, the refilling of the integral tank 30 commences.

Because of the provision of the float 60 operably connected to the switch 25, the vacuum pump 50 is caused to operate when the float 60 has moved into a lowered position, with the vacuum pump serving to bring about a substantial reduction of pressure in the upper interior portion 18 of the vacuum-tight supplemental tank 10. It has already been mentioned that the relatively heavy walled tube 54 connects the vacuum pump 50 to the vacuum-tight fitting 55 disposed in the top member of the supplemental tank 10, which fitting provides communication between the upper interior portion 18 of the tank 10 and the vacuum pump. By virtue of this arrangement, the pump 50 is able to function to bring about a sufficiently low pressure in such upper interior portion of the supplemental tank as to cause water to be drawn from the integral tank, now undergoing the refilling process, upwardly through the relatively short tube 26 into the tank 10. This pulling of water up into the supplemental tank 10 is able to commence at such time as the water level in the integral tank 30 has reached and passed above the bottom ends of the tubes 20 and 26. In other words, a significant vacuum is caused to exist in the interior portion of the vacuum-tight supplemental tank due to the operation of the vacuum pump, which serves to draw water up into the tank 10 through the tube 26 to accomplish the refilling of the supplemental tank to the level 19.

As should now be entirely clear, the flushing of the toilet causes the water in the integral tank to flow down into the toilet bowl 36, to accomplish the flushing of same, with the water contained in the supplemental tank 10 at this time flowing downwardly through the tube 26 to aid considerably in the flushing procedure.

As will apparent from FIG. 3, the outflow of water from the supplemental tank 10 causes the lowering of the float 60 from the water line of the full tank, with this lowering of the float permitting the electrical contacts 28 of the normally closed switch 25 to move into their normal, circuit-closing position. The closing of the circuit in this manner serves to bring about operation of the vacuum pump 50 until such time as the water in the supplemental tank 10 has been caused to return to the pre-established level 19. Upon this level having been reached, the float 60 rises to the position depicted in FIGS. 1 and 2 and the contacts of the switch 25 are caused to open, with this obviously bringing about a cessation of the operation of the vacuum pump.

The overall operation of this embodiment of my invention should now be clear, with it readily understood that when as a direct result of the dropping of the water level in the supplemental tank 10, the arm 66 moves into the position depicted in FIG. 3 thus permitting the contacts of the switch 25 to return to their normally closed condition. It will be recalled that the normally closed contacts 28 of the switch 25 are interposed in a low voltage circuit created by the functioning of the earlier mentioned transformer 58. If the vacuum pump 50 is designed for use in a 12 volt circuit, the transformer is selected so as to provide a voltage of this level.

It should now be quite apparent that the operation of the vacuum pump 50 is sufficient to bring about a desirably low pressure in the upper interior portion 18 of the supplemental tank 10, with the pump 50 continuing to operate as long as the arm 66 of switch 25 remains in the downwardly tilted position. When a sufficient amount of water has been drawn from the refilling integral tank into the supplemental tank, the level 19 in the supplemental tank 10 will be reached, and at this point the float 60 will move the arm 66 of the switch 25 into a position approaching horizontal. This of course causes the circuit to the vacuum pump 50 to be broken by the electrical contacts 28 of switch 25 and the system to assume a rest condition.

Turning now to FIG. 4, it is to be seen that I am not to be limited to the use of a float switch in connection with the automatic refilling of the supplemental tank, for as indicated in FIG. 4, I may utilize an embodiment in which the operation of the vacuum pump 51 is controlled by a vacuum switch 80. The vacuum pump in this instance may be a pump operating on 110 volts AC, supplied from the wall receptacle 57 by a wire 106. As will be seen from this figure, but in greater detail in FIGS. 5 and 6, the vacuum switch involves a housing 82 whose interior portion is separated by a diaphragm 84 into chambers 86 and 88. The chamber 88 must be vacuum tight, whereas ambient air pressure is manifested in chamber 86 by means of a tube or aperture 110.

A pair of electrical contacts 90 and 92 are supported in a spaced, electrically isolated relationship in chamber 86 of the housing 82 by the use of a bracket 98 made of non-conductive material. An electrical wire 94 is connected to contact 90 and an electrical wire 96 is connected to contact 92. The electrical wires 94 and 96 form an intrinsic part of the circuit by which 110 volts can be supplied to the vacuum pump 51, which in this instance is a 110 volt pump such as sold by McMaster-Carr.

It will be noted that a pair of electrical contacts 100 and 102, having the same spacing as contacts 90 and 92, are mounted on the diaphragm 84, so as to be movable therewith. The electrical contacts 100 and 102 are joined together by a shorting bar 104, so that an electrical circuit between the contacts 90 and 92 can be completed at such time as the diaphragm 84 has moved to the left, into the position depicted in FIG. 6, with the contacts 100 and 102 forming a tightly interfitting relationship with the spaced pair of contacts 90 and 92.

Figure 5:
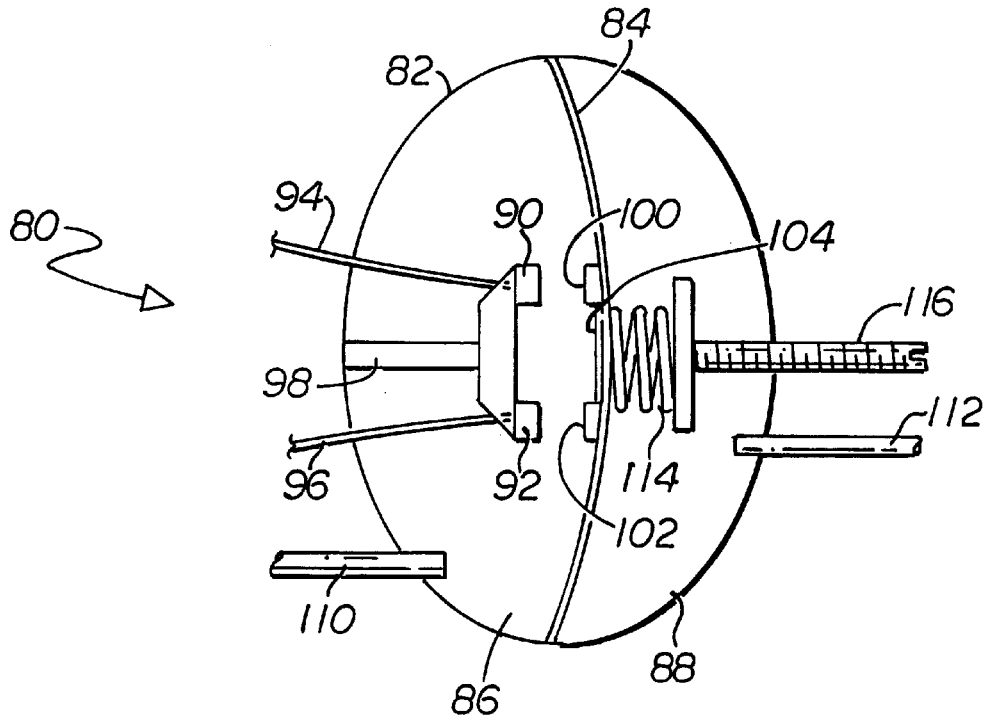
FIG. 5 is a view revealing the details of the vacuum switch utilized in the second principal embodiment of my invention, which vacuum switch contains a movable diaphragm upon which electrical contacts are mounted, with the diaphragm in this instance being in a position corresponding to the supplemental tank being full, and the vacuum pump not operating.

It has already been mentioned that an aperture 110 is provided in one of the sidewalls of the housing 82 in order to permit ambient air pressure to be manifested in chamber 86, whereas a vacuum connection 112 is provided in a tightly fitting manner in the opposite sidewall of the housing 82. The previously mentioned heavy walled tube 54 is to be attached in a no-leak manner to the connection 112, with the connection 112 being so placed that when a sufficient amount of vacuum is manifested in the chamber 88, the diaphragm 84 will be drawn to the right as shown in FIG. 5. This movement of the diaphragm causes electrical contacts 100 and 102 to move away from a touching relationship with fixed electrical contacts 90 and 92, and thus break the electrical circuit through vacuum pump 51.

With momentary reference back to FIG. 4, it is to be understood that at such time as the water in the supplemental tank 10 has risen so as to reach the level 19, the diaphragm 84 of the vacuum switch 80 will reside in approximately the position depicted in FIG. 5, at which time the vacuum pump is not operating.

Figure 6:
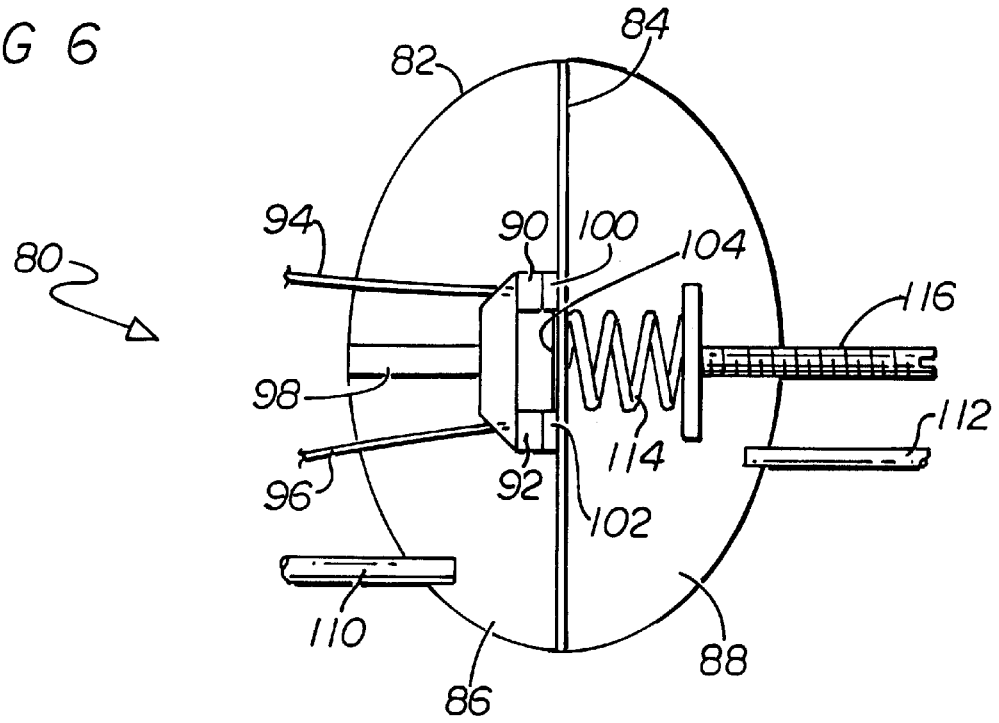
FIG. 6 is a view along the lines of FIG. 5 but showing in this instance a condition in which a lesser vacuum exists in the upper interior portion of the supplemental tank, with the result that the movable diaphragm has moved to a position in which the contacts of the electrical switch have closed to bring about operation of the vacuum pump as will accomplish a refilling of the supplemental tank.

It is to be observed from FIGS. 5 and 6 that I preferably provide a compression spring 114 tending to bias the movable contacts 100 and 102 to the left, to assure the contacts 100 and 102 bringing about a satisfactory connection between the electrically isolated contacts 90 and 92 when a sufficiently great vacuum condition is not being manifested in chamber 88. As will be obvious to those skilled in this art, during the period in which the supplemental tank is being refilled, the amount of vacuum present in chamber 88 will be insufficient to move the diaphragm to the right, so as to cause the contacts 100 and 102 to move away from the fixed contacts 90 and 92.

It is important to note from FIGS. 5 and 6 that I provide an adjustment screw 116 that is operably mounted in the sidewall of the housing 82 adjacent the chamber 88. This adjustment screw makes it readily possible for the operator to determine the precise amount of pressure applied by spring 114 against the diaphragm 84. The force asserted by the spring 114 obviously plays a significant role in determining the extent of the vacuum condition that must be manifested in chamber 88 in order to bring about the diaphragm 84 moving sufficiently far to the right when the tank 10 has been filled as will cause a proper separation of the contacts 100 and 102 from fixed contacts 90 and 92, thus to bring about a cessation of the operation of the vacuum pump 51.

In other words, the adjustment screw 116 enables the user to select the precise water level in the supplemental tank that is desirable. I have found it to be a relatively simple matter to control the water level in tank 10 in ½ inch increments, from a depth of one inch to a depth of say five inches. By suitable manipulation of the adjustment screw 116, the user can select the quantity of water retained in the tank that is most suitable for his or her needs.

When the water level in the supplemental tank 10 has reached the level 19, the extent of the negative pressure manifested in the chamber 88 of the vacuum switch is caused to increase, which causes the contacts 100 and 102 mounted in the diaphragm to move to the position depicted in FIG. 5, in which these contacts are separated from the fixed contacts 90 and 92. As should now be obvious, in this relationship of the contacts, the vacuum pump 51 is caused to cease operation.

With regard to the setting of the vacuum switch 80, should for example the adjustment screw 116 be turned so as to bring about the establishment of a vacuum in the upper interior tank portion 18 corresponding to 12" of water, this will cause water to rise 12" from the top of the water in the integral tank 30. Obviously the relationship between the integral tank and the supplemental tank will vary somewhat from installation to installation, but in a typical instance, there may be a distance of 5" between the water level 33 in the integral tank, and the bottom 14 of the supplemental tank 10.

Continuing with the presumption that a vacuum corresponding to 12" of water exists in the upper interior portion of the supplemental tank, this means that the vacuum in this upper portion will be sufficient to cause 7" of water to rise in the supplemental tank. In one embodiment of this invention, 7" of water in the supplemental tank corresponded to approximately one gallon of water.

It is well known that one gallon of a liquid occupies 231 cubic inches, so the sizing of the supplemental tank to give a desired footprint area will of course determine the number of inches of water that must be drawn into the supplemental tank in order to cause a desired addition to the water in the integral tank as will bring about a satisfactory flushing action for a low flow volume toilet. I have found that one gallon of water in the supplemental tank will typically provide a sufficient additional amount of water for achieving a proper flush, but the needed additional quantity of water may vary from installation to installation.

As should now be clear, when the water level in the supplemental tank 10 is caused to drop as a result of the manipulation of the flush handle 38 and the consequent raising of the flapper valve 48, the pressure previously existing in the upper interior portion 18 of the supplemental tank is caused to become less negative, this being caused by the entry of air from the integral tank up through the elongate tube 20. The diminishment of the negative pressure in the upper interior portion 18 in turn causes the diaphragm 84 to move under the bias of spring 114 into the position depicted in FIG. 6, which brings about the operation of the vacuum pump 51.

As should now be apparent, the utilization of the embodiment of my invention involving the vacuum switch not only makes it possible to dispense with the use of a transformer, but also it enables the user to readily adjust the amount of water to be maintained in the supplemental tank 10, with no opening or disassembly of the supplemental tank 10 being required. Furthermore, the quantity of water retained in the tank can be varied over a particularly wide range. It has of course been previously mentioned that by the use of the adjustment screw 116, the user is enabled to select the precise water level desired, with it being a relatively simple matter to control the water level in tank 10 in ½ inch increments, from a depth of say one inch to a depth of say five inches.

In accordance with an ancillary feature of my invention, I may provide, as shown in FIG. 7, an arrangement whereby the user can prevent, on certain occasions, the operation of my novel supplemental tank, such as when no solid waste is to be eliminated from the toilet bowl.

It will be noted from FIG. 7 that I have provided a push handle 120, placed atop the supplemental tank 10 within easy reach of the user. The handle 120 is attached to a vertically disposed rod or shaft 124 designed to pass through a vacuum tight seal 122, with a ball 126 of relatively soft texture being attached to the bottom of the rod or shaft 124.

A guide member 128 is utilized for assuring that the rod or shaft 124 is restrained against undesirable lateral movements, with the bottom of the guide member providing a surface against which the ball may at times rest.

The texture of the ball 126 is such that when brought into contact with the opening of the tube 26 that is mounted in a sealed relationship in the bottom member 14 of the tank 10, it can readily block the egress of water downwardly through the tube 26.

By virtue of this arrangement, upon the user deciding that it is not necessary to disperse the contents of the tank 10 at the time of flushing the toilet, he or she need only press down upon the handle 120 to bring about the seating of the ball 126 in the mouth or inlet of the tube 26.

As is obvious, the push handle 120 is released shortly after the toilet has been flushed, with it being understood that at such time as the tank 10 is to be refilled by virtue of the operation of the vacuum pump, the ball 126 will be moved away from a tube-closing position.

I claim:

1. A supplemental tank for use with a low flow volume toilet equipped with an integral tank that serves to supply water for the flushing of the toilet, said supplemental tank being configured to rest atop the integral tank of the toilet, said supplemental tank having a top member, bottom member, and sidewalls extending in a vacuum-tight manner between said top and bottom members, means for providing communication between said supplemental tank and the tank integral with the toilet, said means including at least one elongate tube mounted in a sealed manner in said bottom member in a generally perpendicular relationship with said bottom member, a lower portion of said tube extending below said bottom member, said lower portion, when said supplemental tank has been placed atop the integral tank of the toilet, being of sufficient length to extend down into the water normally contained in the integral tank, a hollow fitting connected to an upper portion of said supplemental tank, said fitting enabling a connection to be made to a source of vacuum, so that the vacuum can create, on occasion, a reduced pressure in the upper interior portion of said supplemental tank, whereby upon the toilet being flushed, water is caused to flow out of the integral tank and into the toilet bowl, and as a result of the provision of said elongate tube, water contained in said supplemental tank is caused to flow under the influence of gravity into the integral tank, to aid in the flushing of the toilet, and activation means for bringing about the onset of the application of the vacuum to the upper interior portion of said supplemental tank subsequent to the flushing of the toilet, to cause a reduction of the pressure in such upper interior portion, with such reduction of pressure causing water to be drawn from the integral tank during its refilling, upwardly through said elongate tube to bring about the refilling of the supplemental tank, and means for causing a cessation of the application of vacuum to said upper interior portion when the water in said supplemental tank has reached a certain pre-established level.

2. The supplemental tank for use with a low flow volume toilet equipped with an integral tank as recited in claim 1 in which the source of vacuum is a vacuum pump.

3. The supplemental tank for use with a low flow volume toilet equipped with an integral tank as recited in claim 2 in which said activation means for bringing about operation of said vacuum pump as well as the later cessation of the operation of said vacuum pump when the water level in said supplemental tank has been restored to a certain pre-established level is a float switch mounted in said supplemental tank.

4. The supplemental tank for use with a low flow volume toilet equipped with an integral tank as recited in claim 2 in which said activation means for bringing about operation of said vacuum pump as well as the later cessation of the operation of said vacuum pump when the water level in said supplemental tank has been restored to a certain pre-established level is a vacuum switch mounted to sense the pressure in the upper interior portion of said supplemental tank.

5. The supplemental tank for use with a low flow volume toilet equipped with an integral tank as recited in claim 1 in which said means for providing communication between said supplemental tank and the integral tank involves a pair of elongate tubes, with a first of said tubes being of a greater length than that of the second tube, with both of said tubes being of a length to extend below said supplemental tank and into the water normally contained in the integral tank of the toilet.

6. A supplemental tank for use with a low flow volume toilet equipped with an integral tank that serves to supply water for the flushing of the toilet, said supplemental tank being configured to rest atop the integral tank of the toilet, said supplemental tank having a top member, bottom member, and sidewalls extending in a vacuum-tight manner between said top and bottom members, means for providing communication between said supplemental tank and the tank integral with the toilet, said means including at least one elongate tube mounted in a sealed manner in said bottom member in a generally perpendicular relationship with said bottom member, a lower portion of said tube extending below said bottom member, said lower portion, when said supplemental tank has been placed atop the integral tank of the toilet being of sufficient length to extend down into the water normally contained in the integral tank, a hollow fitting connected to an upper portion of said supplemental tank, said fitting enabling a connection to be made to a vacuum pump, so that the vacuum pump can create, on occasion, a reduced pressure in the upper interior portion of said supplemental tank, whereby upon the toilet being flushed, water is caused to flow out of the integral tank and into the toilet bowl, and as a result of the provision of said elongate tube, water contained in said supplemental tank is caused to flow under the influence of gravity into the integral tank, to aid in the flushing of the toilet, and activation means for bringing about operation of the vacuum pump subsequent to the flushing of the toilet, to cause a reduction of the pressure in the upper interior portion of said supplemental tank, with such reduction of pressure causing water to be drawn from the integral tank during its refilling, upwardly through said elongate tube to bring about the refilling of the supplemental tank, and shutoff means for causing a cessation of the operation of the vacuum pump when the water in said supplemental tank has reached a certain pre-established level.

7. The supplemental tank for use with a low flow volume toilet equipped with an integral tank as recited in claim 6 in which said means for providing communication between said supplemental tank and the integral tank involves a pair of elongate tubes, with a first of said tubes being of a greater length than that of the second tube, with both of said tubes being of a length to extend below said supplemental tank and into the water normally contained in the integral tank of the toilet.

8. The supplemental tank for use with a low flow volume toilet equipped with an integral tank as recited in claim 6 in which said activation means for bringing about operation of the vacuum pump as well as the later cessation of the operation of the vacuum pump when the water level in said supplemental tank has been restored to a certain pre-established level is a float switch mounted in said supplemental tank.

9. The supplemental tank for use with a low flow volume toilet equipped with an integral tank as recited in claim 6 in which said activation means for bringing about operation of the vacuum pump as well as the later cessation of the operation of the vacuum pump when the water level in said supplemental tank has been restored to a certain pre-established level is a vacuum switch mounted to sense the pressure in the upper interior portion of said supplemental tank.

10. A supplemental tank for use with a low flow volume toilet equipped with an integral tank that serves to supply water for the flushing of the toilet, with the integral tank being supplied with a source of water and being installed at a level above the toilet bowl so as to deliver water by gravity to the toilet bowl at the time a flush handle is manipulated, said supplemental tank being utilized in association with a vacuum pump, with said supplemental tank being configured to rest atop the integral tank of the toilet, said supplemental tank having a top member, bottom member, and sidewalls extending in a vacuum-tight manner between said top and bottom members, means for providing communication between said supplemental tank and said integral tank, said means including at least one elongate tube mounted in a sealed manner in said bottom member in a generally perpendicular relationship with said bottom member, with said tube being of sufficient length for a lower portion of said tube to extend below said bottom member and into the water normally contained in the integral tank of the toilet, the vacuum pump being connected to the upper interior portion of said supplemental tank and when energized, serving to bring about a low pressure in such upper interior portion of said supplemental tank, the toilet, upon being flushed, causing the flow of water out of the integral tank and into the toilet bowl, and as a result of the provision of said elongate tube, water contained in said supplemental tank is caused to flow into the integral tank, to aid in the flushing of the toilet, and means for activating the vacuum pump upon water flowing out of said supplemental tank, to bring about a reduction of the pressure in the upper interior portion of said supplemental tank, with such reduction of pressure causing water to be drawn from the integral tank during its refilling, upwardly through said elongate tube to bring about the refilling of said supplemental tank, and means for causing a cessation of the operation of the vacuum pump when the water in said supplemental tank has reached a certain pre-established level.

11. The supplemental tank for use with a low flow volume toilet equipped with an integral tank as recited in claim 10 in which said means for providing communication between said supplemental tank and the integral tank involves a pair of elongate tubes, with a first of said tubes being of a greater length than that of the second tube, with both of said tubes being of a length to extend below said supplemental tank and into the water normally contained in the integral tank of the toilet.

12. The supplemental tank for use with a low flow volume toilet equipped with an integral tank as recited in claim 10 in which said activation means for bringing about operation of the vacuum pump as well as the later cessation of the operation of the vacuum pump when the water level in said supplemental tank has been restored to a certain pre-established level is a float switch mounted in said supplemental tank.

13. The supplemental tank for use with a low flow volume toilet equipped with an integral tank as recited in claim 12 in which the height at which said float switch is mounted in said supplemental tank can be adjusted, so that the height of the water maintained in said supplemental tank can be selected.

14. The supplemental tank for use with a low flow volume toilet equipped with an integral tank as recited in claim 10 in which said activation means for bringing about operation of the vacuum pump as well as the later cessation of the operation of the vacuum pump when the water level in said supplemental tank has been restored to a certain pre-established level is a vacuum switch mounted to sense the pressure in the upper interior portion of said supplemental tank.

15. The supplemental tank for use with a low flow volume toilet equipped with an integral tank as recited in claim 14 in which means are provided on said vacuum switch for enabling the amount of vacuum maintained in said supplemental tank to be readily adjusted, thus to control the height of the water in said tank.

16. A supplemental tank for use with a low flow volume toilet equipped with an integral tank that serves to supply water for the flushing of the toilet, with the integral tank having a flush handle and being supplied with a source of water, the integral tank being placed above the level of the toilet bowl so as to deliver, when the flush handle has been manipulated, water by gravity to the toilet bowl, said supplemental tank being configured to rest atop an upper portion of the integral tank of the toilet, said supplemental tank having a top member, bottom member, and sidewalls extending in a vacuum-tight manner between said top and bottom members, means for providing communication between said supplemental tank and said integral tank, said means including at least one elongate tube mounted in a sealed manner in said bottom member in a generally perpendicular relationship with said bottom member, with said tube being of sufficient length for a lower portion of said tube to extend down into the water normally contained in the integral tank of the toilet, said supplemental tank utilized in association with a vacuum pump connected to the upper interior portion of said supplemental tank, to bring about a low pressure in such upper interior portion thereof, the toilet, upon being flushed, causing the flow of water out of the integral tank, and as a result of the provision of said elongate tube, water contained in said supplemental tank is caused to flow under the influence of gravity into the integral tank, to aid in the flushing of the low flow toilet, and means for activating the vacuum pump, to cause a reduction of the pressure in the upper interior portion of said supplemental tank, thus to cause water to be drawn upwardly through said elongate tube at the time of the refilling of the integral tank, thus to bring about the refilling of said supplemental tank, and means for causing a cessation of the operation of the vacuum pump when the water in said supplemental tank has reached a certain pre-established level.

17. The supplemental tank for use with a low flow volume toilet equipped with an integral tank as recited in claim 16 in which said means for providing communication between said supplemental tank and the integral tank involves a pair of elongate tubes mounted in a sealed manner in said bottom member, with a first of said tubes being of a greater length than that of the second tube, with both of said tubes being of a length to extend down into the water normally contained in the integral tank of the toilet.

18. The supplemental tank for use with a low flow volume toilet equipped with an integral tank as recited in claim 16 in which said means for causing a cessation of the operation of the vacuum pump when the water level in said supplemental tank has reached a certain pre-established level is a float switch mounted in said supplemental tank.

19. The supplemental tank for use with a low flow volume toilet equipped with an integral tank as recited in claim 16 in which said means for causing a cessation of the operation of the vacuum pump when the water level in said supplemental tank has reached a certain pre-established level is a vacuum switch mounted to sense the pressure in the upper interior portion of said supplemental tank.

* * * * *